United States Patent [19]

Betzler

[11] 4,429,726

[45] Feb. 7, 1984

[54] MACHINE FOR CARRYING OUT MILLING, PLANING, AND SIMILAR OPERATIONS

[75] Inventor: Otto Betzler, Tauberbischofsheim, Fed. Rep. of Germany

[73] Assignee: Michael Weinig GmbH & Co. KG, Tauberbischofsheim, Fed. Rep. of Germany

[21] Appl. No.: 290,492

[22] Filed: Aug. 6, 1981

[30] Foreign Application Priority Data

Aug. 9, 1980 [DE] Fed. Rep. of Germany ..... 3030206

[51] Int. Cl.[3] ..... B27C 5/00

[52] U.S. Cl. ..... 144/134 R; 144/3 R; 144/117 R; 144/230; 407/39; 407/73; 407/79

[58] Field of Search ..... 144/218, 229, 230, 172, 144/174, 162, 130, 134 R; 407/36, 37, 38, 39, 87, 44, 45, 73, 40, 96, 97, 79

[56] References Cited

U.S. PATENT DOCUMENTS

| | | | |
|---|---|---|---|
| 899,608 | 9/1908 | Newbold | 407/45 |
| 909,434 | 1/1909 | Malmedie | 407/45 |
| 994,331 | 6/1911 | Newbold | 407/45 |
| 2,037,642 | 4/1936 | Scribner | 407/39 |
| 2,722,410 | 3/1953 | Brown | 407/97 |
| 3,014,511 | 3/1959 | Kirsten | 144/230 |
| 3,214,825 | 12/1963 | Williams | 407/87 |
| 3,326,252 | 6/1967 | Pease | 144/172 |

*Primary Examiner*—Francis S. Husar
*Assistant Examiner*—Jorji M. Griffin
*Attorney, Agent, or Firm*—Bell, Seltzer, Park & Gibson

[57] ABSTRACT

The cutter blades of the cutter heads of the present machine are supported in such a manner that they may be quickly and accurately adjusted for varying the cutting depth of the cutter blades. The cutter blades are supported in groove-shaped receptacles equally spaced around the cutter head and means is provided for adjustably supporting and positively locking the cutter blades in the desired adjusted position in the groove-shaped receptacles. An adjusting plate is fixed to the cutter blade by mating sawtoothlike grooves to provide a primary adjustment of the cutter blades. The adjustment plate including a guide surface which includes a gradient component extending in at least one adjustment direction of the cutting blade so that secondary adjustments may be made to the position of the cutter blade.

6 Claims, 15 Drawing Figures

6c
6d
6c, 6d
2
5
18
16
15
31
32
3
8
30

MACHINE FOR CARRYING OUT MILLING, PLANING, AND SIMILAR OPERATIONS

FIELD OF THE INVENTION

The invention relates generally to a machine for carrying out milling, planing, and similar operations on workpieces composed of wood, plastic and similar materials, and more particularly to a cutter head for such a machine which includes means for quickly and accurately adjusting the cutting depth of the cutter blades carried thereby.

BACKGROUND OF THE INVENTION

In a known machine of this type, the cutter blades of the cutter head are retained, by positive locking, against one wall of the groove-shaped receptacle. The cutter blade is retained in the receptacle by means of a clamping part, which is pressed against the cutter blade by means of screws. The cutting circle of the cutter head is defined by the outer cutting edges of the cutter blades, these cutting edges projecting beyond the periphery of the cutter head. If the cutting edges are worn, they must be removed from the receptacle, reground, and resecured in the receptacle of the cutter head. The readjustment of all the cutter blades of the cutter head, to the original cutting circle diameter, now creates considerable difficulties. After each adjustment, a test run is required in order to determine the exact cutting circle diameter. If, for example, high quality timber workpieces are to be machined, one of these high quality and expensive pieces of wood must always be used as a test sample. Moreover, a single adjustment frequently does not suffice, but readjustments are required, with the result that, once used in the case of each readjustment, these test pieces of timber are scrap, and can no longer be used for further processing.

Machines are also known, which have cutter heads in which the cutter blades are formed by reversible cutting tips. When the cutting edges of such cutter blades are blunt, they are not reground, but are reversed. However, even in the case of this reversing procedure, expensive and tedious adjustments are necessary in order to regain the original cutting circle diameter.

For this reason, there has been a trend towards using so-called throw-away cutting tips or blades in the cutter heads. If the cutting tips are blunt, they are exchanged for new cutting tips. However, the individual cutting tips also have manufacturing variations among themselves, with the result that it is generally impossible to set the desired exact cutting circle diameter in the case of simply exchanging the cutting tips, and readjustments are likewise necessary.

SUMMARY OF THE INVENTION

The object of the invention is to provide adjustment means for supporting the cutter blades on the cutter head in such a way that the cutter blades, perhaps after a regrinding operation or in the event of being exchanged, can be set to the precise cutting circle diameter within an extremely short time, so that it should no longer be necessary to run the workpiece to be machined through the machine by way of a test.

This object is achieved, according to the invention, by attaching the cutter blades, by positive locking, to at least one adjusting part, which is accommodated in the groove-shaped receptacle and is supported on the cutter head carrier. This adjusting part includes at least one guide surface which has a gradient component extending in at least one adjustment direction of the cutter blade, and at least one setting device is provided to act on the cutter blade adjusting part for the purpose of adjusting the same.

In order to set the cutter blades in a precise manner, the adjusting part is adjusted by means of the setting device. Since the control surface of the adjusting part has a gradient component extending in the adjustment direction of the cutter blade, and the cutter blade is attached to the adjusting part by positive locking, the cutter blade is adjusted by the desired amount in the outward direction, transversely to the axis of the cutter head. The setting device enables the cutter blade to be set very sensitively and precisely, so that the cutting edge can be adjusted to the precise cutting circle diameter, simply and within an extremely short time. Readjustments can be rechecked by means of dial indicators or other suitable measuring instruments, so that a test run is no longer necessary, and the machining of the workpiece can be started immediately after adjusting the cutter blades. Scrapping of workpieces is thereby avoided, an advantage which becomes particularly noticeable in the case of expensive workpieces. As a result of the simple adjustability, the cutter heads can even be retooled within an extremely short time, in order to machine workpieces having different dimensions. The machine is accordingly particularly suitable for series of workpieces involving low numbers of parts, because a considerable amount of time is saved on each occasion when the cutter heads are retooled, in contrast to the known machines.

BRIEF DESCRIPTION OF THE DRAWINGS

Further objects and features of the invention will appear as the description proceeds when taken in connection with the drawings, in which.

DESCRIPTION OF THE ILLUSTRATED EMBODIMENTS

Figure 2:
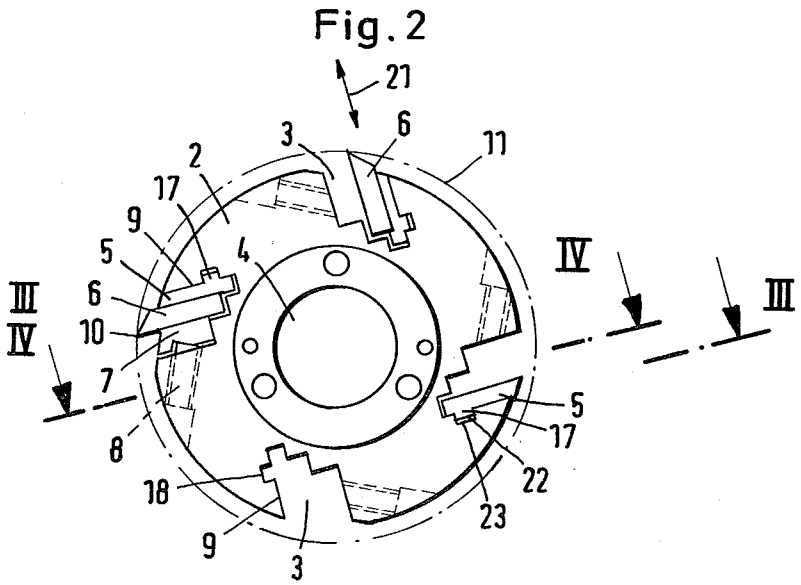
FIG. 2 is an end view of the cutter head according to FIG. 1, illustrating the assembly of the adjusting part, of the cutter blade, and the clamping part, in the receptacles of the cutter head.
Figure 4:
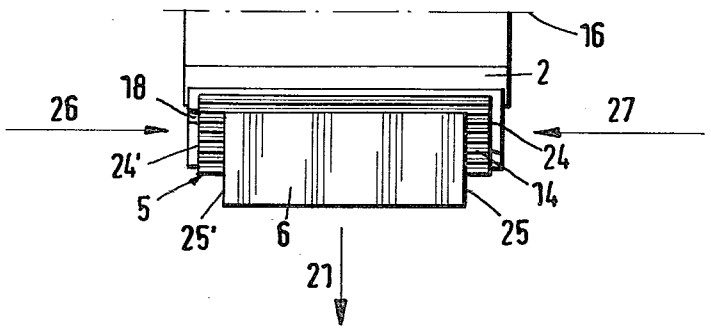
FIG. 4 is a somewhat schematic fragmentary sectional view along the line IV—IV in FIG. 2.
Figure 1:
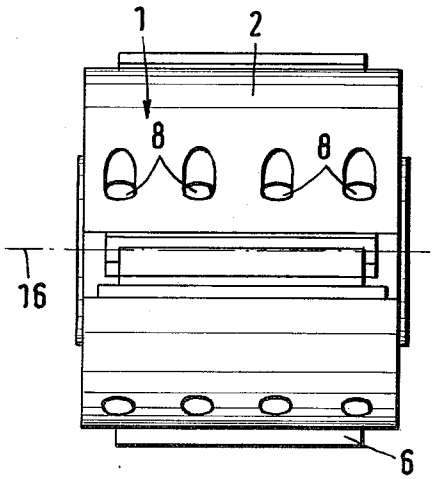
FIG. 1 is an elevational view of a cutter head of a machine according to the invention.
Figure 14:
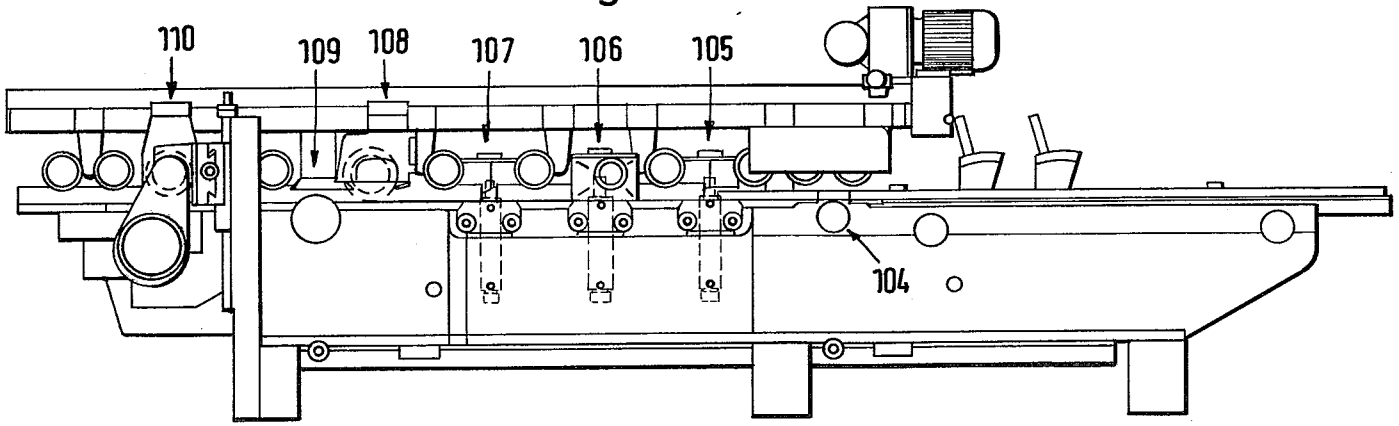
FIG. 14 is a diagrammatic side elevational view of a molding machine equipped with cutter heads according to the invention.
Figure 15:
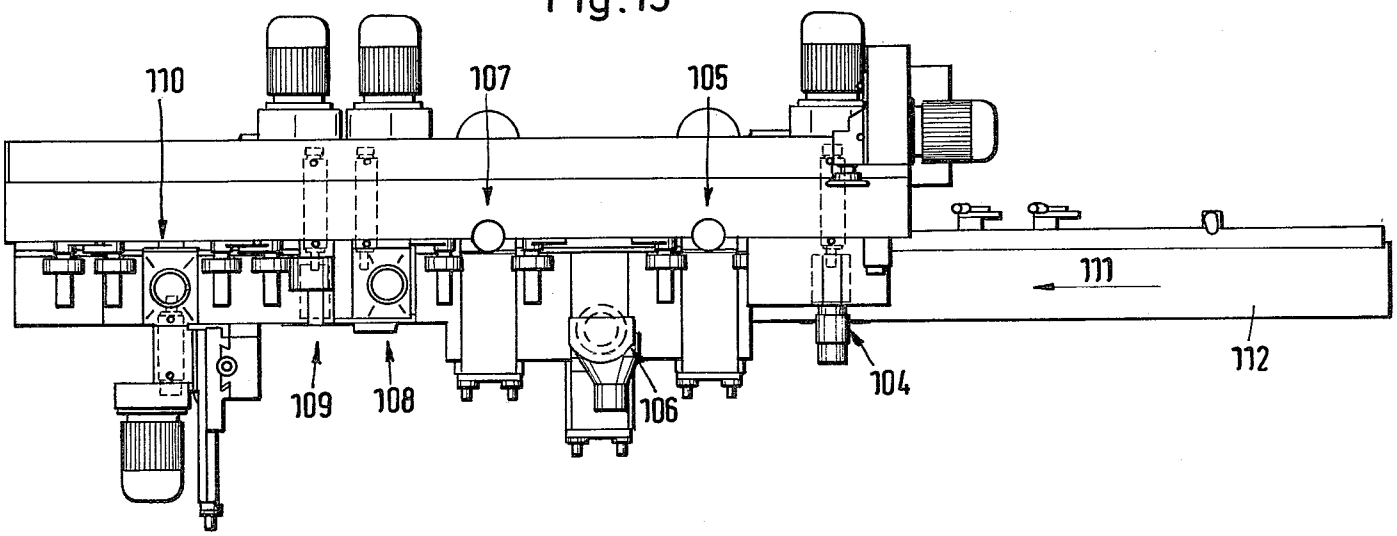
FIG. 15 is a plan view of the molding machine of FIG. 14.

The cutter head, broadly indicated at 1, and illustrated in FIGS. 1 to 4, includes a circular carrier 2, on the periphery of which four groove-shaped receptacles 3 are provided, spaced at equal intervals. The carrier 2 has a central bore 4 to enable it to be secured on a spindle, such as spindles 104 to 110 in FIGS. 14 and 15, of a machine for carrying out milling, planing, and similar operations on workpieces composed of wood, plastic and similar materials. An adjusting plate or part 5, a cutter blade 6, and a clamping plate or part 7 are mounted in each receptacle 3. The clamping part 7, which is designed as a clamping wedge, is pressed against one side of the cutter blade 6, by means of claimping screws 8, the cutter blade 6 in turn clamping the adjusting part 5 against the associated wall 9 of the groove 3. The clamping screws 8 are arranged to be countersunk, so that they do not project beyond the periphery of the carrier 2 (FIG. 2).

The cutter blades 6 project beyond the carrier 2, and their cutting edges 10 determine the cutting circle 11 of the cutter head 1.

The adjusting part 5 is designed in the form of a plate, and rests, by means of its rear side 12 (FIG. 10), that is the side facing away from the cutter blade 6, flat against the wall 9 of the groove-shaped receptacle 3. The front side 13 (FIG. 10) of the adjusting part 5 is provided with sawtoothlike grooves 14 (FIGS. 4 and 10) which engage similar sawtoothlike grooves 15 (FIG. 13) provided in the cutter blade 6. The grooves 14 and the corresponding grooves 15 extend, in each case, over the entire length of the adjusting part 5 and of the cutter blade 6, so that the latter is safely retained in the receptacle 3, transversely to the carrier axis 16. In its turn, the adjusting part 5 is attached, by positive locking, to the carrier 2, transversely to the carrier axis 16, so that the adjusting part cannot slip out of the receptacle 3 during operation.

Figure 3:
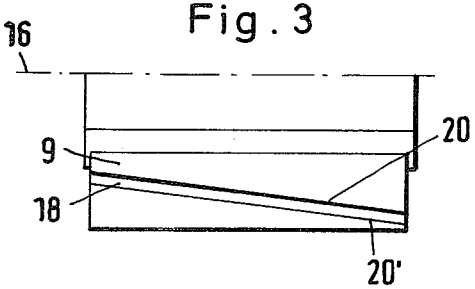
FIG. 3 is a fragmentary sectional view along the line III—III in FIG. 2.
Figure 6:
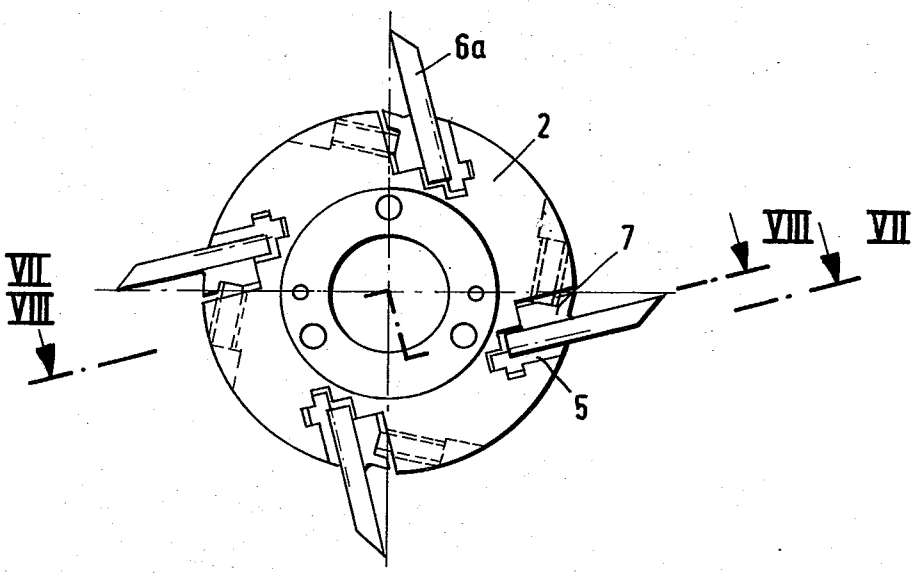
FIGS. 5 to 8 correspond to FIGS. 1 to 4 and illustrate a second embodiment of a cutter head, which is tipped with the cutter blades for machining windows.
Figure 8:
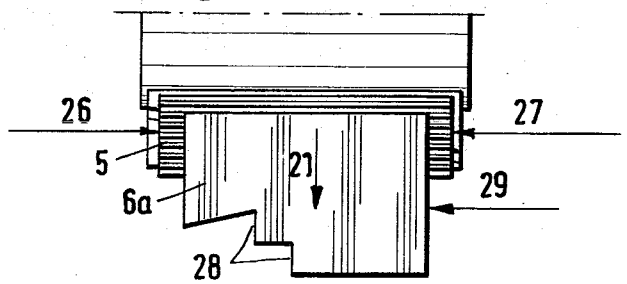
Figure 5:
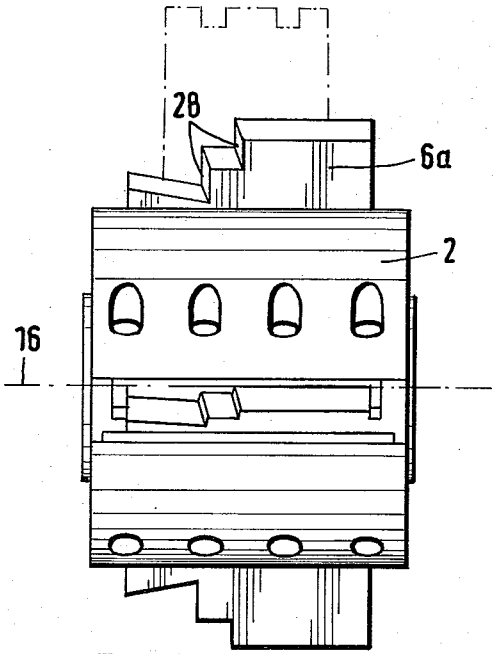
Figure 7:
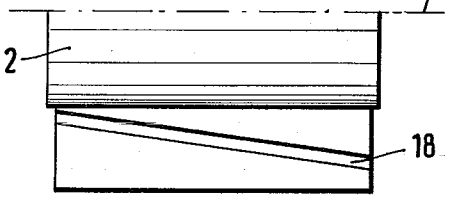
Figure 10:
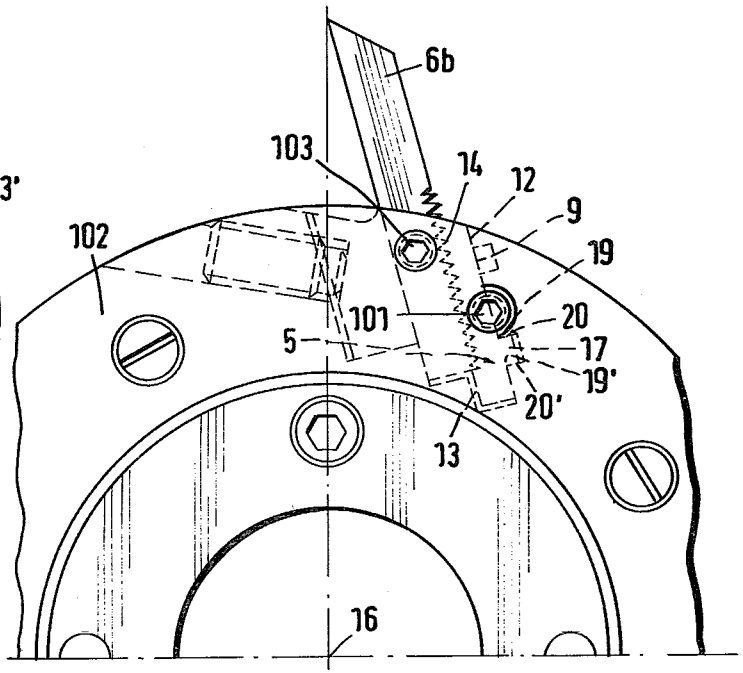
FIG. 10 is an end view of that portion of the cutter head shown in FIG. 9.

The positive locking between the adjusting part 5 and the cutter head carrier 2 is brought about by means of a key-type guide part 17, which projects outwardly from the rear side 12 of the adjusting part and engages into a groove 18 in the wall 9 of the receptacle 3 (FIGS. 3 and 10). The groove 18 extends over the entire length of the wall 9 and is inclined selective to the carrier axis 16 (FIG. 3). This positively locked attachment between the adjusting part 5 and the carrier 2 serves not only to secure the adjusting part 5 and the cutter blade 6 against slipping out of the receptacle 3, but also enables the cutter blade 6 to be adjusted transversely to the carrier axis 16 and relative to the cutting circle 11. For this purpose, the key-type guide part 17 possesses guide surfaces 19, 19' (FIG. 10) which, viewed with respect to the carrier axis 16, form the upper and lower sides of the guide part 17. The guide surfaces rest on counter-surfaces 20, 20', which form the opposite side surfaces of the grooves 18 (FIG. 3). The guide part 17 of the adjusting part 5 can be shifted longitudinally along and inside the groove 18, whereupon the surfaces 19, 19' and 20, 20' slide on one another.

In order to achieve an adjustment of the cutter blade 6, transversely to the carrier axis 16, when the adjusting part 5 is shifted, the groove 18 is located at an acute angle with respect to the carrier axis 16 (FIG. 3). Correspondingly, the guide part 17 of the adjusting part 5 also extends obliquely with respect to the carrier axis 16. Due to this inclinded positioning of the groove 18 and of the guide part 17, the guide surfaces 19, 19' have a gradient component extending in the outward and inward adjustment direction 21 of the cutter blade 6. If the adjusting part 5 is shifted along the groove 18, the cutter blade 6, which is positively locked to the adjusting part, is adjusted, transversely to the carrier axis 16, in the outward or inward direction, depending on the direction in which the adjusting part 5 is shifted, so that the cutting edges 10 can be adjusted to the desired cutting circle 11.

A front face 22 connects the two guide surfaces 19, 19' of the guide part 17 and is located at a distance inwardly from the base 23 of the groove 18 (FIG. 2), so that there is no danger of the guide part 17 sticking in the groove 18 when the adjusting part 5 is shifted. The groove 18 preferably has a rectangular cross section, the countersurfaces 20, 20' being located approximately at right angles to the adjustment direction 21 of the cutter blade 6. The adjusting part 5 is thereby safely secured against slipping out of the receptacle 3.

The gradient of the guide part 17, and of the groove 18, with respect to the carrier axis 16, corresponds at least to the tooth spacing of the sawtoothlike grooves 14 and 15. The cutter blade 6 can thereby be shifted in the adjustment direction 21, by shifting the adjusting part 5, by a total distance of at least one tooth spacing. It is possible, in this manner, to quickly and easily set the cutter blade 6 to within one tooth spacing of the cutting circle diameter desired.

Figure 9:
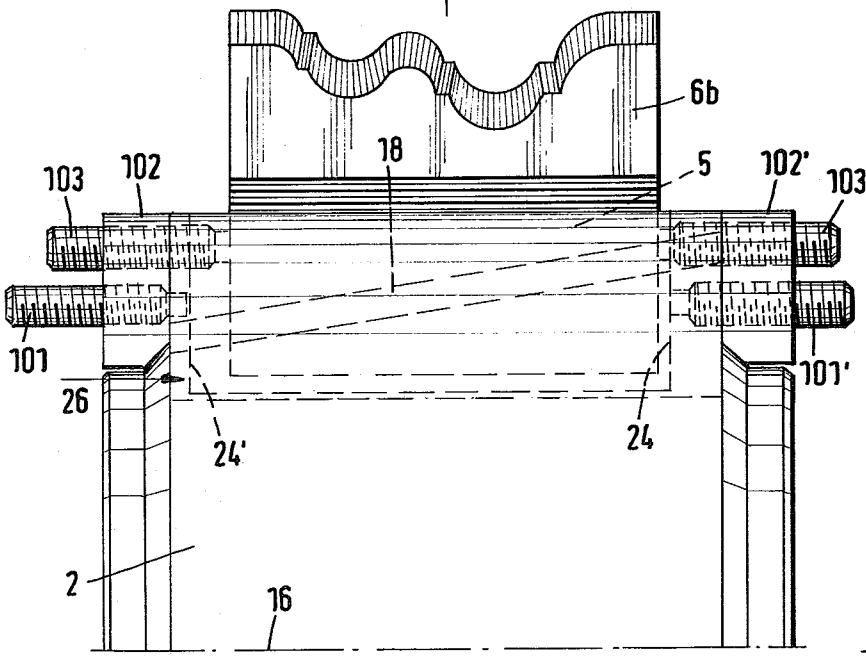
FIG. 9 is an enlarged elevational view of a portion of a cutter head having a profile cutter blade for producing a profile section for furniture.

In order to shift the adjusting part 5, to make the final accurate adjustment of the blade 6, a setting device 101, 101' is provided (FIGS. 9 and 10). The setting device 101, 101' engages the two narrow sides 24, 24' of the adjusting part 5, located transversely to the carrier axis 16, and is mounted in corresponding external rings 102, 102' which are secured to the cutter head carrier 2 (FIGS. 9 and 10). The setting device 101, 101' is formed, in each case, by a threaded stud, acting on the narrow sides 24, 24' of the adjusting part 5. By appropriately turning the threaded studs, the adjusting part is shifted, by means of its guide part 17, in the groove 18, in the desired direction. In order to ensure that the cutter blade 6 conserves its axial position while the adjusting part 5 is shifted, a setting device 103, 103' is likewise provided for the cutter blade 6, this device likewise being formed by threaded studs acting on the two narrow sides 25, 25' of the cutter blade 6 located transversely to the carrier axis 16 (FIGS. 9 and 10). Moreover, adjustment of the setting device, i.e., loosening of screw 103 and tightening of screw 103' or vice versa will provide axial adjustment of the cutter blade (6) relative to the cutter head carrier (2). The threaded studs forming the setting device 103, 103' are mounted in the external rings 102, 102' and in the cutter head carrier 2. This setting device 103, 103' retains the cutter blade 6 in its axial position when the adjusting part 5 is shifted. For this purpose, the sawtoothlike grooves 14 and 15 of the adjusting part 5 and of the cutter blade 6 extend parallel to the carrier axis 16, so that, on shifting the adjusting part, the adjusting part 5 is, at the same time, also shifted relative to the cutter blade 6. The cutter blade 6 remains in the axial position to which it has been adjusted, due to the sawtoothlike grooves 14, 15 which are located parallel to the carrier axis 16.

Since the groove 18 extends over the entire length of the wall 9 of the receptacle 3, a sufficiently large adjustment travel is available to the adjusting part 5. In the embodiments illustrated, a single key-type guide part 17 extends over the entire length of the adjusting part 5, thus guaranteeing uniform loading of the adjusting part 5. However, a plurality of guide parts 17 can also be provided on the adjusting part 5, these guide parts 17 being formed by projections and being spaced apart from one another.

The cross section of the groove 18 can, for example, also be designed in the shape of part of a circle. The rectangular cross section of the groove 18, as described, is nevertheless preferred, because this configuration reliably prevents the adjusting part from being pushed out of the groove 18 as a result of the stresses occurring during operation.

The sawtoothlike grooves 14 and 15 also extend over the entire length of the adjusting part 5, and of the cutter blade 6, so that a comparatively large adjustment range is provided. It is advantageous for the cutter blade 6 to be shorter than the adjusting part 5, and, in particular, by an amount such that the cutter blade 6 does not project beyond the narrow sides 24, 24' of the adjusting part 5 when the latter is shifted, or when the cutter blade 6 is shifted axially. The adjusting part 5 then supports the cutter blade 6, over its entire length, in every adjustment position.

The cutter head 1 according to FIGS. 1 to 4 is a planing head for machining smooth surfaces. If the cutter blades 6 are blunt or worn, they must be reground and then reclamped in the receptacles 3. In order now to be able to readjust the cutting edges 10 of all the cutter blades 6 to the original cutting circle diameter 11, it is necessary only to shift the adjusting part 5 in the setting direction 26, 27 (FIG. 4), by means of the setting device 101, 101', which has been described. At the same time, the adjusting part 5 and the cutter blade 6, which is positively locked thereto, are shifted in the adjustment direction 21, as a result of the inclined positioning of the groove 18, and of the guide part 17, with respect to the carrier axis 16. At the same time, the cutter blade 6 is securely retained, in the axial direction, by means of the associated setting device 103, 103', so that, despite the fact that the adjusting part 5 is shifted, the cutter blade 6 conserves its axial position and is adjusted only transversely to the carrier axis 16. By this means, the cutter blade 6 can be adjusted exactly to the original cutting circle diameter 11, and this adjustment can be rechecked, in a simple manner, by means of dial indicators or other suitable measuring instruments.

In the case of the known cutter heads, the cutter blades can, after regrinding, be resecured in the receptacle only when displaced by one tooth spacing. In order to be able to readjust the cutter blades exactly to the original cutting circle diameter, it is necessary, in this situation, either to regrind the cutter blades so precisely that they lie on the cutting circle diameter, or the associated cutter head spindles must be designed to be adjustable, as is customary. Since, after each regrinding of the cutter blades, the cutter heads must be readjusted and positioned, very long adjustment times are required, amounting, for example in the case of a molding machine, to approximately one hour. Furthermore, the adjustment of the spindles requires the provision of elaborate and expensive adjusting devices in the machine itself, these devices being susceptible to faults and thereby reducing the ruggedness of the entire machine.

The cutter head of the present invention dispenses with these expensive readjustments following each regrinding of the cutter blades. The cutter blades need only be located in the receptacle in their approximate installed position, and only the adjusting part 5 need then be shifted in the desired direction. Since the gradient of the groove 18 corresponds to at least one tooth spacing, it is possible, in every case, to adjust the cutter blade to the original cutting circle. After carrying out the adjustment of the cutter blade 6, it only remains to tighten the clamping screws 8, and to clamp the cutter blade 6 securely in the receptacle 3.

Since, in present-day modern woodworking, increasing numbers of multi-spindle machines, so-called molding machines, are being employed, the advantage of the very short adjustment and retooling times manifests itself in a particularly advantageous way. The molding machine, illustrated in FIGS. 14 and 15, includes spindles 104 to 110, which carry cutter heads by means of which a workpiece is machined on its upper and lower surfaces, as well as on its two sides, when run through the machine in the direction 111. The horizontal spindles 104, 109 are located below a table 112 of the machine, while the horizontal spindles 108, 110 are located above the machine table 112. In the direction 111 through the machine, the vertical spindles 105, 107 are located to the right of the machine table 112, and the vertical spindle 106 is located to the left of the table 112. The molding machine, equipped with the cutter heads according to the invention, can be retooled within five to ten minutes. In the case of this molding machine, all vertical spindles 105, 107 to the right of the table, and all horizontal spindles 104, 109 below the table can be permanently set, so that adjusting devices are no longer necessary for these spindles. The necessary correction of the cutting circle of the cutter blades is achieved by shifting the cutter blades 6 by means of the adjusting parts 5. In the case of the horizontal spindles 108, 110 above the table, and in the case of the left-hand vertical spindle 106, the contact shoulders of the spindles are permanently adjusted and fixed, with respect to the right-hand lateral stop, in the case of the former spindles, and with respect to the upper edge of the table, in the case of the latter spindle. In the event of a change of profile section, it is then only necessary to adjust the left-hand vertical spindle 106 to the width dimension of the workpiece, and to adjust the horizontal spindles 108, 110, above the table, to the thickness dimension. Due to the design of the cutter heads, described above, this adjustment can be carried out so precisely that even the first workpiece conforms perfectly to the required dimensions, and is not scrap. In the case of machines with cutter heads of this type, it is possible to automate the machine to a still greater extent, to provide it with an N/C system, and to control the adjustment by means of a program preloaded into this system. When these cutter heads are employed, the productive machine running time is significantly increased, since the long retooling times no longer occur.

In the illustrative embodiments described, the lateral adjustability of the adjusting part 5, in the direction 26, 27, is designed in such a manner that the cutting circle 11 of the cutter blades 6 is adjusted by one tooth spacing in the case of 10 mm of adjustment travel. If the cutter blades 6 are reground by an amount corresponding to the tooth spacing, all cutter blades must be set outwards by one tooth spacing, and the adjusting part 5 must be brought into its starting position. The cutter blade is then adjusted as described above.

Planing tools or, alternatively, profiling tools can be inserted into the cutter head.

In the case of the illustrative embodiment according to FIGS. 5 to 8, the cutter blades 6*a* are provided for machining windows. The cutter blades are clamped in the groove-shaped receptacle in the same way as in the case of the illustrative embodiment previously described. The cutter head 1, with the clamping part 7 and the adjusting part 5, are designed in the same way as in the case of the embodiment previously described, as is the adjustment of the adjusting part 5. This adjustment is effected in the same manner as in the case of the previous illustrative embodiment.

Since the cutter blade 6*a* also has axial cutting edges 28, and these must likewise be reground, the cutter blade 6*a* must be adjusted not only transversely to the carrier axis 16, but also parallel to this axis. Even in this case, the cutter blade 6*a* can be precisely readjusted to the initial setting. In order to effect this readjustment, the adjusting part 5 is first shifted, thus setting the cutting circle diameter of the cutter head. During the adjustment of the adjusting part 5, the axial position of the cutter blade 6*a* is secured by means of the associated setting device 103, 103'. The cutter blade 6*a* is afterwards pushed, parallel to the carrier axis 16, back into the zero setting (arrow 29 in FIG.8), by means of the setting device 103, 103', the adjusting part 5 now being axially secured by the associated setting device 101, 101'. It is then necessary only to tighten the clamping screws 8, whereupon the cutter head, and hence the machine, are ready to operate.

The cutter head according to FIGS. 9 and 10 is likewise designed identically to the embodiments previously described. A profile cutter blade 6*b*, designed for producing a profile section for furniture, is used as the blade.

Figures 11, 12, 13:
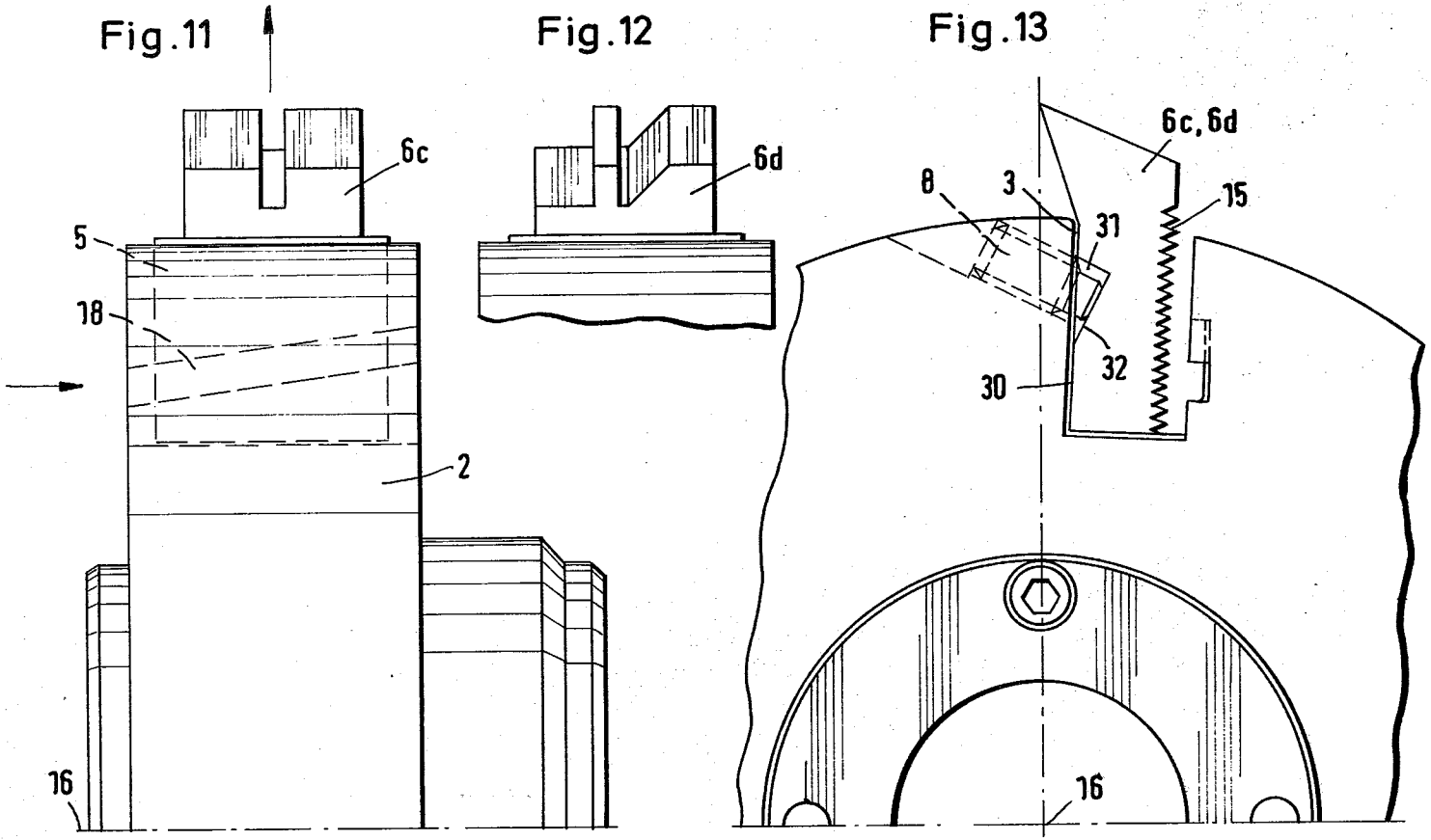
FIG. 11 is a fragmentary elevational view of a cutter head with a further embodiment of a profile cutter blade for producing a groove in the manufacture of falsework for ceilings.
FIG. 12 shows a further embodiment of a cutter head having a profile cutter blade for manufacturing loose cross tongues of ceiling falsework.
FIG. 13 is an end view of the portion of the cutter head shown in FIG. 11.

FIGS. 11 to 13 show a cutter head with a tongue-and-groove cutter set for the production of falsework for ceilings. The grooves in the ceiling boards are produced by means of the cutter blade 6*c*, while the associated tongues are produced in the ceiling boards by means of the cutter blade 6*d*. The cutter blades 6*c*, 6*d* are adjusted in the same manner as in the case of the illustrative embodiments previously described. The cutter blade, however, is clamped in the receptacle 3 and against the adjusting part 5, shown removed in FIG. 13, by the clamping screws 8. In order to do this, the cutter blade has a recess 31 on its side 30 opposite the sawtoothlike grooves 15, the base 32 of this recess being arranged at an inclination such that the clamping screws are located at right angles to this base (FIG.13). After loosening the clamping screws 8, the cutter blades 6*c*, 6*d* can be adjusted, both axially and transversely to the carrier axis 16, corresponding to the embodiments previously described.

Instead of the setting devices for the adjusting part of the cutter blades, being formed by threaded studs, it is also possible to provide setting devices which are separate from the cutter head, and which can be hydraulically, pneumatically, or electrically controlled in an accurate manner. The adjusting part 5 and the cutting blade 6 can also be adjusted and set by means of separate adjusting devices.

In the drawings and specification there have been set forth preferred embodiments of the invention, and although specific terms are employed, they are used in a generic and descriptive sense only and not for purposes of limitation, the scope of the invention being defined in the claims.

That which is claimed is:

1. In a machine for carrying out milling, planing, and similar operations of workpieces composed of wood, plastic and similar synthetic materials, said machine including at least two drive spindles, each of which carries a circular cutter head (2) rotatable about a carrier axis (16) and having radially spaced groove-shaped receptacles (3) on the peripheral surface for supporting cutter blades (6) therein, the combination therewith of means for adjustably supporting said cutter blades (6) in each of said groove-shaped receptacles with their outer cutting surfaces accurately positioned along a cutting circle diameter (11), said adjustable blade supporting means comprising an adjusting plate (5) supported along one wall (9) of said groove-shaped receptacle (3), said adjusting plate (5) including a key-type guide (17) extending at an inclined angle and outwardly from a front side (13) of said adjusting plate (5) adjacent said wall (9) of said groove-shaped receptacle (3), an inclined groove (18) extending along said wall (9) and slidably receiving said key-type guide (17) therein, said inclined key-type guide (17) and said inclined groove (18) providing minor inward and outward radially directed adjustment of said adjusting plate with transverse movement of said adjusting plate (5) from side to side of said groove-shaped receptacle (3), a cutter blade (6) supported against a rear side (12) of said adjusting plate (5) and including sawtoothlike grooves (15) on one side, sawtoothlike grooves (14) on said rear side (12) of said adjusting plate (15) and mating with said sawtoothlike grooves (15) on said cutter blade (6), said sawtoothlike grooves (14, 15) extending parallel to said carrier axis (16) and permitting major inward and outward adjustments of said cutter blade (6) relative to said adjustable plate (5), said inclined angle of said key-type guide (17) defining an acute angle relative to said sawtoothlike grooves (14, 15), first setting means (101, 101') supported on opposite end portions of said cutter head carrier (2) and being engageable with opposite end portions of said adjusting plate (5) for imparting side to side movement to said adjusting plate (5) and to thereby provide minor inward and outward adjustments of said adjusting plate (5) and said cutter blade (6) relative to said cutting circle diameter (11), second setting means (103, 103') supported on opposite end portions of said cutter head carrier (2) and being engageable with opposite end portions of said cutter blade (6) for permitting side to side adjustment of the cutter blade (6), whereby when said second setting means (103, 103') axially fixes said cutter blade (6), adjustment of said adjusting plate (5) relative to the cutter blade (6) restricts movement of the cutter blade (6) to the radial direction only and locking means (7) carried by said groove-shaped receptacle (3) for maintaining said adjusting plate (5) and said cutter blade (6) in adjusted position in said groove-shaped receptacle (3).

2. In a machine according to claim 1 wherein the inclined angle of said key-type guide (17) and said inclined groove (18), relative to said carrier axis (16), corresponds at least to the tooth spacing of said sawtoothlike grooves (14, 15).

3. In a machine according to claim 1 wherein said sawtoothlike grooves (14, 15) on said respective adjusting plate (5) and cutter blade (6) extend over their entire axial length.

4. In a machine according to claim 1 wherein said cutter blade (6) has a given length, and wherein said adjusting plate (5) has a length which is longer than the length of said cutter blade (6).

5. In a machine according to claim 1 including an external ring (102, 102') fixed on each end of said cutter head carrier (2), and wherein said first setting means includes a threaded stud (101, 101') threadably supported in said external rings (102, 102'), said threaded studs including inner ends in engagement with opposite ends of said adjusting plate (5) and being operable to impart side to side movement to said adjusting plate (5).

6. In a machine according to claim 5 wherein said second setting means includes threaded studs (103, 103') threadably supported in said external rings (102, 102') and having inner freed ends in engagement with opposite ends of said cutter blade (6).

* * * * *